US012552572B2

(12) United States Patent
Mandeville

(10) Patent No.: US 12,552,572 B2
(45) Date of Patent: Feb. 17, 2026

(54) CUTTING AND ROLLING DEVICE FOR USE WITH PHARMACEUTICAL POUCH PACKAGING

(71) Applicant: PARATA SYSTEMS, LLC, Durham, NC (US)

(72) Inventor: Andrew Scott Mandeville, Durham, NC (US)

(73) Assignee: PARATA SYSTEMS, LLC, Durham, NC (US)

( * ) Notice: Subject to any disclaimer, the term of this patent is extended or adjusted under 35 U.S.C. 154(b) by 0 days.

(21) Appl. No.: 18/434,046

(22) Filed: Feb. 6, 2024

(65) Prior Publication Data

US 2024/0270431 A1 Aug. 15, 2024

Related U.S. Application Data

(60) Provisional application No. 63/514,685, filed on Jul. 20, 2023, provisional application No. 63/484,605, filed on Feb. 13, 2023.

(51) Int. Cl.
*B65B 63/04* (2006.01)
*B65B 51/06* (2006.01)
(Continued)

(52) U.S. Cl.
CPC ..... *B65B 63/04* (2013.01); *B65B 51/06* (2013.01); *B65B 61/06* (2013.01); *B65H 18/10* (2013.01)

(58) Field of Classification Search
CPC . B65B 63/04–06; B65B 51/06; B65H 18/026; B65H 2301/4132
(Continued)

(56) References Cited

U.S. PATENT DOCUMENTS 4,161,298 A * 7/1979 Davis ..... B65H 54/585 242/532.6
4,783,948 A * 11/1988 Kando ..... B65H 54/585 53/586
(Continued)

FOREIGN PATENT DOCUMENTS

CN 110980361 A * 4/2020 ..... B65H 23/26
EP 0608906 A2 * 8/1994 ..... B65B 63/045
(Continued)

OTHER PUBLICATIONS

Drawing of "Pin-Driving Mechanism", A device previously offered for sale by Parata Systems, LLC, at least prior to Feb. 13, 2023, in a machine sold under the tradename Parata Perl, (1 page).
(Continued)

*Primary Examiner* — Joshua G Kotis
(74) *Attorney, Agent, or Firm* — Myers Bigel, P.A.

(57) ABSTRACT

A winding mechanism for a machine for cutting and rolling a strip includes: first and second spaced apart vertical walls; a member fixed to and spanning the first and second vertical walls to form a frame; a spindle rotatably mounted in the first vertical wall; a cylindrical body rotatably mounted in the second vertical wall and coupled to the spindle; a hub slidably and rotatably mounted on the spindle with first and second pins that are slidable relative to the cylindrical body; a rotary drive unit mounted to the first vertical wall and coupled to the spindle; a linear actuator; and a carriage mounted on the linear actuator for linear movement and slidably mounted on the spindle, the carriage engaging the hub and permitting rotation of the hub. The carriage moves along the linear actuator between a retracted position, wherein the first and second pins are retracted into the cylindrical body, and an extended position, in which ends of the first and second pins extend beyond the cylindrical body.

16 Claims, 11 Drawing Sheets

(51) Int. Cl.
*B65B 61/06* (2006.01)
*B65H 18/10* (2006.01)

(58) Field of Classification Search
USPC ..... 53/118, 119, 430
See application file for complete search history.

(56) References Cited

U.S. PATENT DOCUMENTS 5,533,689 A * 7/1996 Chalfant ..... B65H 18/10 242/532.5
6,212,855 B1 * 4/2001 Yasunaga ..... B65B 63/06 53/119
6,690,998 B1 * 2/2004 Yuyama ..... B65B 5/103 53/154
6,799,685 B1 * 10/2004 Yuyama ..... G07F 17/0092 209/552
2007/0145179 A1 * 6/2007 Engelsher ..... A61F 15/007 242/532.6
2013/0248642 A1 * 9/2013 Niwa ..... B65H 19/26 242/522
2013/0264376 A1 * 10/2013 Kim ..... B65B 51/06 229/87.05
2014/0306053 A1 * 10/2014 Karius ..... B65H 18/10 242/532.6
2016/0058633 A1 * 3/2016 Broten ..... B65H 54/585 242/546
2017/0008655 A1 * 1/2017 Amano ..... B65H 16/103
2017/0158449 A1 * 6/2017 Kramer ..... B32B 43/006

FOREIGN PATENT DOCUMENTS

WO WO-0206125 A1 * 1/2002 ..... B65H 18/10
WO WO-2015163756 A1 * 10/2015 ..... B32B 43/006

OTHER PUBLICATIONS

Photographs of "Ziuz Mechanism", illustrating a device offered for sale by Ziuz Medical prior to Feb. 13, 2023, (1 page).

* cited by examiner

CUTTING AND ROLLING DEVICE FOR USE WITH PHARMACEUTICAL POUCH PACKAGING

RELATED APPLICATION

The present application claims priority from and the benefit of U.S. Provisional Patent Application Nos. 63/484,605, filed Feb. 13, 2023, and 63/514,685, filed Jul. 20, 2023, the disclosures of which are hereby incorporated herein by reference in full.

FIELD OF THE INVENTION

The present invention relates to packaging systems and, more particularly, to packaging systems capable of dispensing and packaging medicaments in selected different types of packages.

BACKGROUND OF THE INVENTION

Automatic dispensing machines are utilized by retail and high volume pharmacies and by pharmacies of hospitals, nursing homes and other long-term care facilities to automatically provide medicaments and nutraceuticals required to fulfill patient prescription orders. Such automatic dispensing machines are computer controlled and can automatically dispense loose, bulk form medicaments from on-board storage units, such as cassettes, into forms suitable for patients.

Increasingly, medicaments are desired to be delivered to the patient packaged in what is known as a "compliance" or "multi-dose" package. A compliance package is a type of packaging in which a patient's medicaments are grouped in a package or packages by administration time and arranged in a sequence in which each package of medicaments is to be taken by the patient. Each medicament represents a separate dosage unit and each package may contain one or more medicaments based on the patient's prescription regimen. The medicaments in the compliance package are taken by the patient in the sequence, first-to-last, in which medicaments are provided in the compliance package at the designated administration times (e.g., breakfast, lunch, dinner, bedtime).

The compliance package represents an important improvement over conventional containers such as vials and bottles which include a 30, 60, or 90 day count of medicaments. With conventional medicament containers, the responsibility for following the physician's prescription order lies with the patient who must select and access the required medicament from the containers at the correct time of day. This may be difficult for some patients because the containers may look alike and because the patient must remember the sequence in which the medicaments are to be taken; in addition, the patient may not have a good system to keep track of all doses taken and may not recall if a particular dose of medicament has been taken at the appropriate time. In contrast, compliance packaging allows the pharmacy to help the patient follow the physician's prescription orders by placing the medicaments in the proper groups and sequence for the patient. In short, compliance packaging encourages the patient to comply with the doctor's prescription order, potentially resulting in improved health outcomes.

Pouch packages (which can be produced by automatic dispensing machines) can represent a type of compliance packaging. This is because the individual pouch packages can be grouped and loaded by the pharmacy and arranged serially in a pouch package web (also referred to as a "strip" or "vine"). Each individual pouch package can contain each required medicament to be taken at a particular time and the pouch packages collectively can be arranged in the web in the sequence one-after-the-other in which the medicaments are to be taken by the patient. Pouch packages are not limited to multi-dose compliance packaging and can also be utilized for "unit dose" packaging in which all or a certain number of packaged medicaments are alike, each holding a single dose of medication.

Strips of pouches are often provided in a coiled or spooled form, with the strip including medications for a single patient, for a location, or for patients in a particular floor, department, ward or other area of a hospital or other health facility. The coiled or spooled strip may be included in a surrounding carton, box or the like to facilitate dispensing (e.g., uncoiling) of the strip by the patient or caretaker. As such, it may be desirable to provide a technique for producing a strip of pouches in the form of a coiled package that can be dispensed to one or more patients at the proper time and dosage.

SUMMARY

As a first aspect, embodiments of the invention are directed to a winding mechanism for a machine for cutting and rolling a strip of pharmaceutical pouches. The winding mechanism comprises: first and second vertical walls, wherein the second vertical wall is spaced apart from and generally parallel with the first vertical wall; a member fixed to and spanning the first and second vertical walls to form a frame; a spindle rotatably mounted in the first vertical wall; a cylindrical body rotatably mounted in the second vertical wall and coupled to the spindle to rotate with the spindle; a hub slidably and rotatably mounted on the spindle, the hub including first and second pins that extend into and are slidably relative to the cylindrical body; a rotary drive unit mounted to the first vertical wall and coupled to the spindle to rotate the spindle relative to the first and second vertical walls; a linear actuator mounted to one of the first and second vertical walls; and a carriage mounted on the linear actuator for linear movement and slidably mounted on the spindle between the hub and the first vertical wall, the carriage engaging the hub and permitting rotation of the hub relative to the carriage. The carriage is movable along the linear actuator between a retracted position, wherein the first and second pins are retracted into the cylindrical body, and an extended position, in which ends of the first and second pins extend beyond the cylindrical body.

As a second aspect, embodiments of the invention are directed to a machine for cutting and rolling a strip of pharmaceutical pouches. The machine comprises: a housing with a horizontal platform and a vertical side wall; a first roller mounted on a front side of the side wall above the platform, a second roller mounted on the front side of the side wall, the second roller forming a nip with the first roller; and a winding mechanism (such as that described above) mounted on the side wall, wherein the second vertical wall is fixed relative to the side wall. In the extended position the first and second pins extend forwardly of the side wall.

As a third aspect, embodiments of the invention are directed to a method of forming a coiled segment of a strip. The method comprises:

(a) feeding a leading end of a strip of pouches along a platform and between two generally horizontal pins located adjacent the platform and in an extended position, with a first pin extending above the platform and a second pin extending below the platform;

(b) rotating the pins about a first axis of rotation to capture the leading end of the strip of pouches between the pins and to form a coiled strip radially outwardly of the pins, the rotation of the pins being driven by a drive unit having an output axis of rotation that is different than the first axis of rotation;

(c) cutting the strip at a desired location to form a strip segment having a lagging end;

(d) continuing to rotate the pins until the lagging end reaches the pins to form a coiled strip segment; and (e) with a linear actuator that defines a second axis that is parallel to but different from the first axis and the output axis, retracting the pins into a retracted position to disengage the coiled strip segment from the pins.

DETAILED DESCRIPTION OF THE INVENTION

Figure 1:
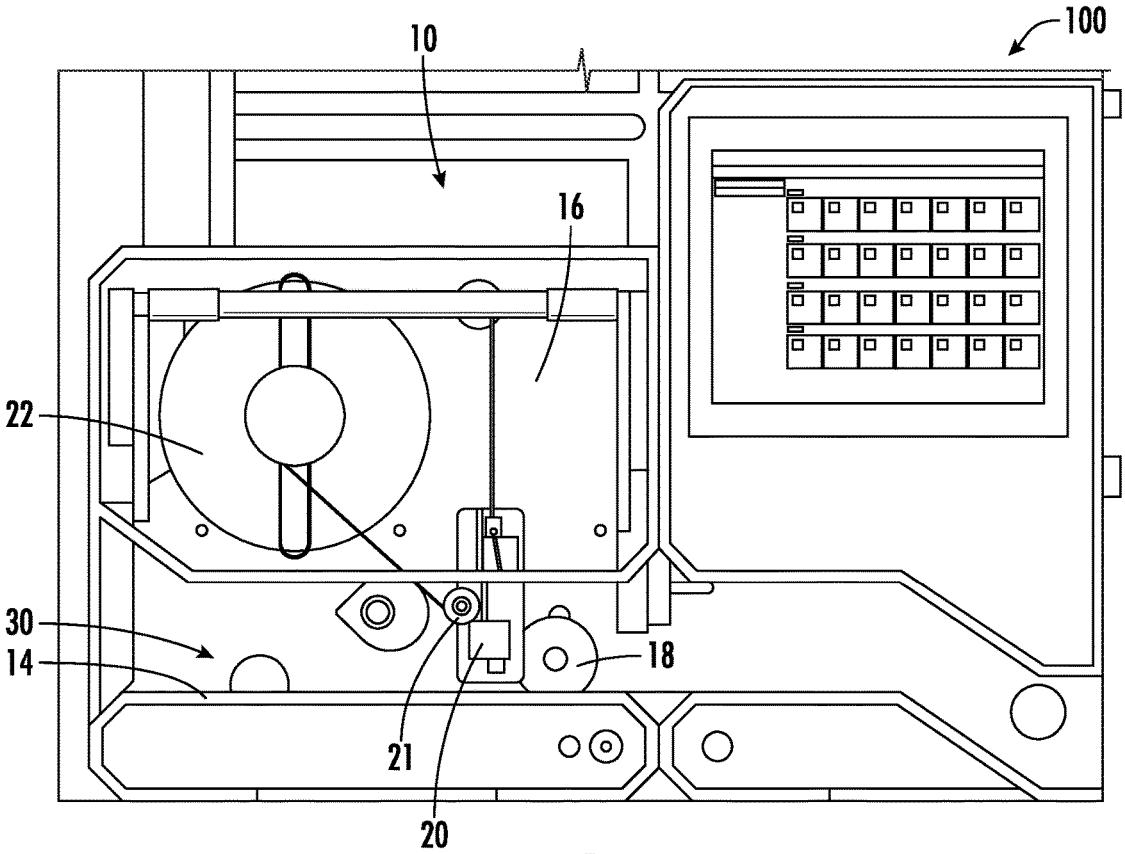
FIG. 1 is a front view of a cutting and winding machine according to embodiments of the invention positioned adjacent an inspection machine.
Figure 2:
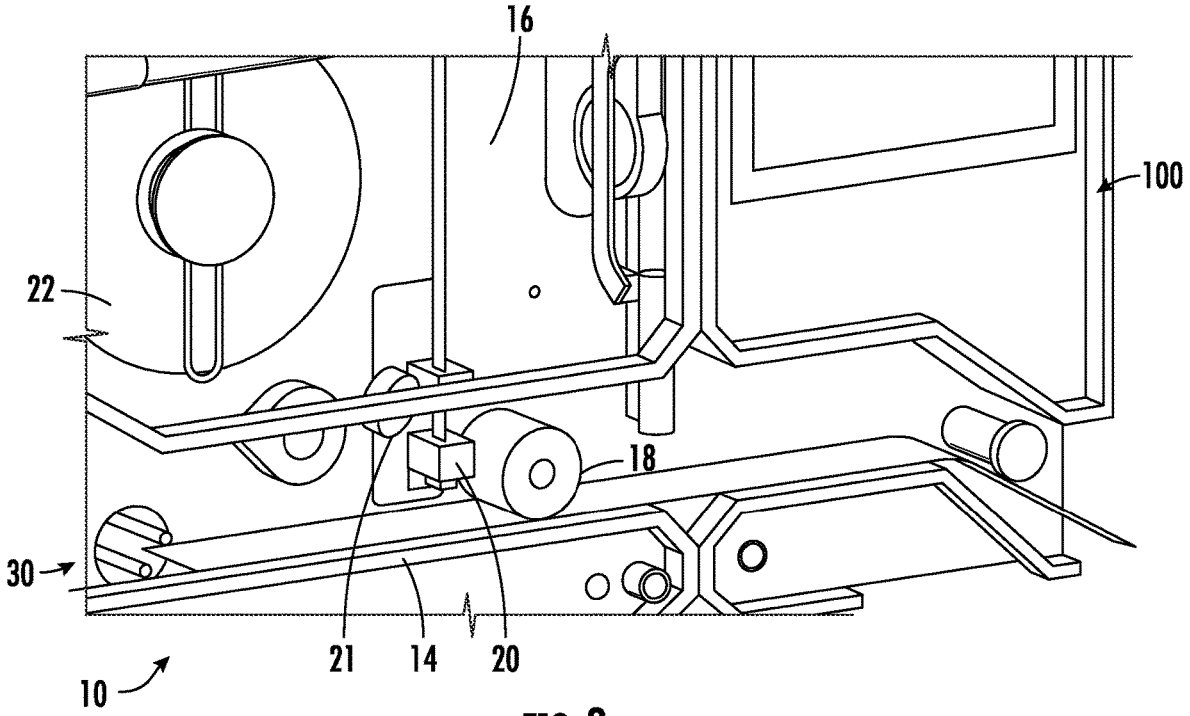
FIG. 2 is a partial front perspective view of the cutting and winding machine of FIG. 1.

The present invention is described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

Like numbers refer to like elements throughout. In the figures, the thickness of certain lines, layers, components, elements or features may be exaggerated for clarity.

The terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "lateral", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

It will also be understood that, as used herein, the terms "example," "exemplary," and derivatives thereof are intended to refer to non-limiting examples and/or variants embodiments discussed herein, and are not intended to indicate preference for one or more embodiments discussed herein compared to one or more other embodiments.

Referring now to the drawings, FIGS. 1-4 shows a cutting and winding machine, designated broadly at 10, that can receive a long strip of pouches filled with medicaments, cut the strip to appropriate segments (e.g., by patient, care facility, etc.), and roll the segments into coils for subsequent packaging and use. The machine 10 includes an overall housing 12 with a horizontal platform 14 and a side wall 16. An L-shaped foundation 17 with horizontal and vertical panels 17*a*, 17*b* is positioned behind the side wall 16. A horizontally disposed roller 18 is mounted on one side (i.e., the front side) of the foundation 17 just above the upstream end of the platform 14 to form a nip with a second roller (not shown) that is mounted just below the platform 14. A motor (not shown) is mounted on the opposite side (i.e., the rear side) of foundation 17 for driving the lower roller. Both a cutting station 20 and a taping station 21 are mounted on the foundation 17 just downstream of the roller 18. A tape supply roll 22 that feeds tape to the taping station 21 is mounted on the foundation 17 well above and forwardly of the cutting and taping stations 20, 21. Each of the roller 18, the cutting station 20, the taping station 21 and the tape supply reel 22 extend through holes in the side wall 16 so that they can be accessed from a position in front of the side wall 16.

A winding mechanism 30 is mounted on the foundation 17 adjacent the platform 14 downstream of the cutting and taping stations 20, 21. Details of the winding mechanism 30 are discussed below.

Figure 11:
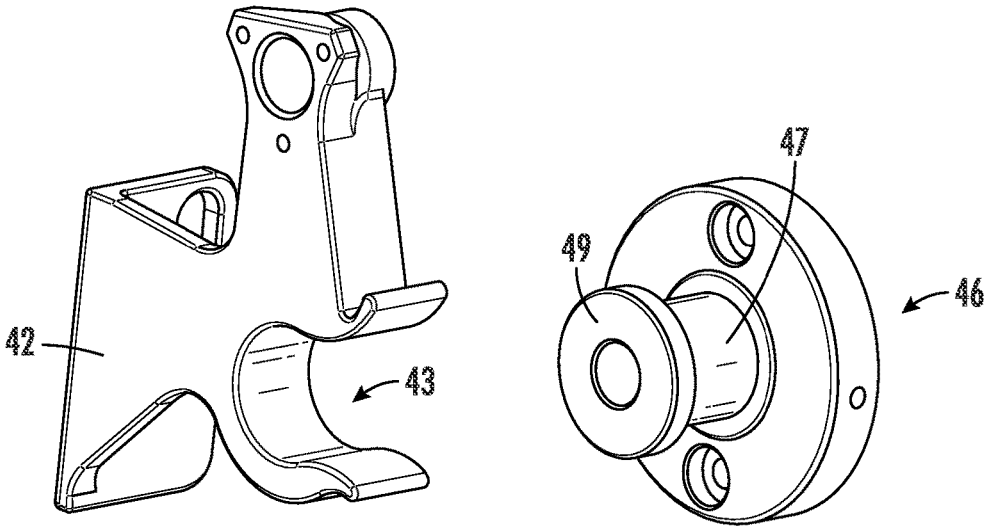
FIG. 11 is a rear exploded perspective view of the carriage and hub of the winding mechanism of FIG. 5.
Figure 12:
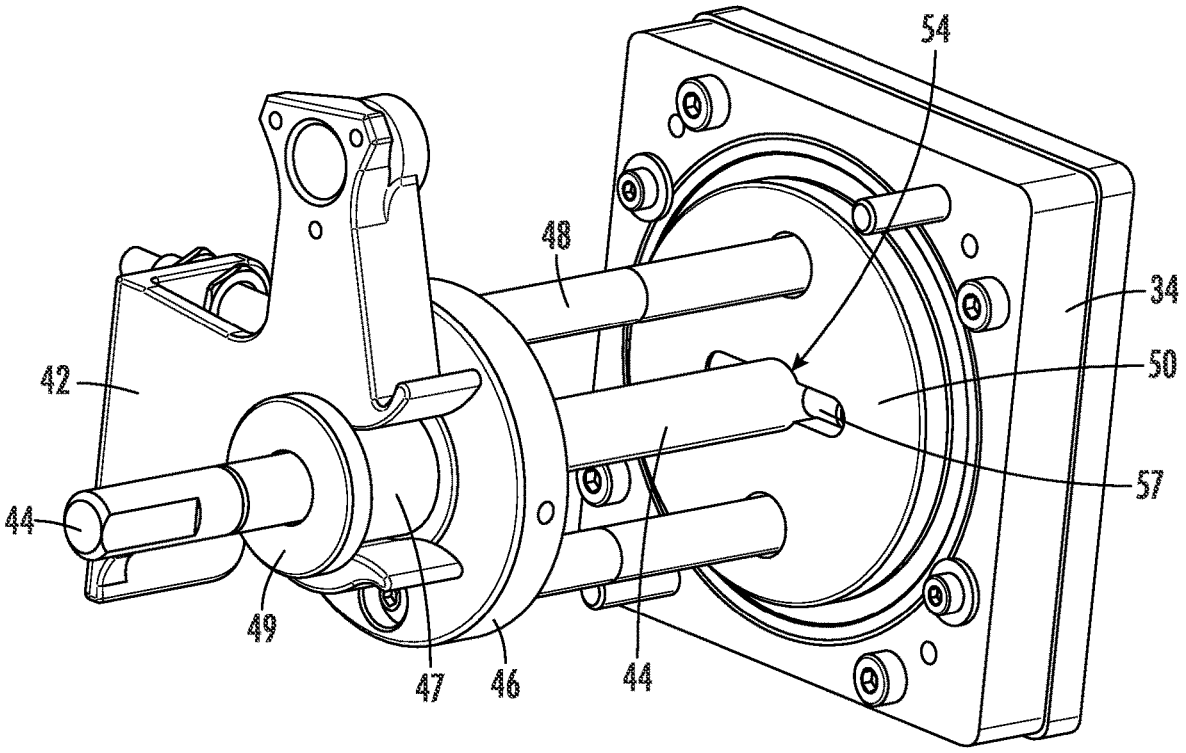
FIG. 12 is a rear partial perspective view of the winding mechanism of FIG. 5 showing the engagement of the carriage and hub.
Figure 13:
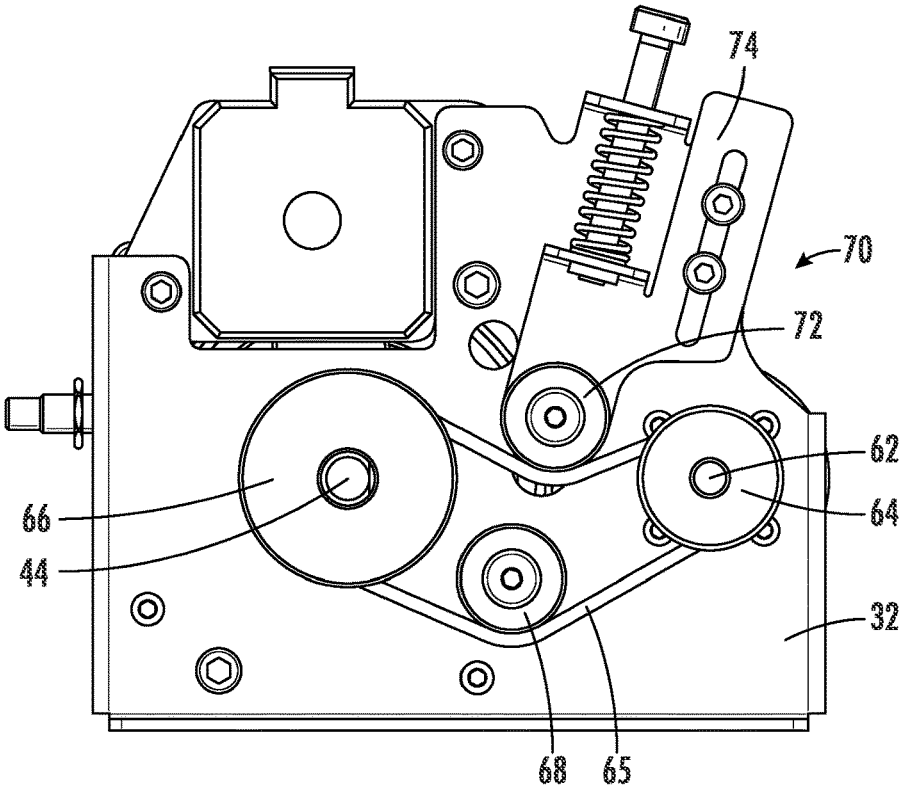
FIG. 13 is a rear view of the winding mechanism of FIG. 5.

Referring now to FIGS. 5-8, the winding mechanism 30 is shown therein. The winding mechanism 30 includes parallel vertical walls 32, 34 that are spaced from each other. The vertical wall 34 is fixed to and located rearwardly of the vertical panel 17*b* of the foundation 17. Two rods 35 or other members span the vertical walls 32, 34 to form a rigid frame. A linear actuator 36 is mounted to the upper end of the vertical wall 32. A screw 37 extends horizontally from the motor 40 of the linear actuator 36 toward the vertical wall 34. A carriage 42 is mounted to the screw 37 for linear movement relative thereto along an axis of rotation upon rotation of the screw 37 by the motor 40. A spindle 44 is also rotatably mounted to the vertical wall 32 below the linear actuator 36 and extends toward the vertical wall 34. A hub 46 with horizontal pins 48 is mounted on the spindle 44 and is free to slide and rotate relative to the spindle 44 about an axis of rotation that is parallel to but different than the axis defined by the linear actuator 36. The hub 46 includes a cylindrical collar 47 on the side opposite the pins 48; a lip 49 is present at the end of the collar 47. The carriage 42 includes an open-ended semicircular recess 43 that receives the collar 47 of the hub 46. The lip 49 retains the carriage 42 in engagement with the hub 46 (see FIGS. 11 and 12).

Figure 3:
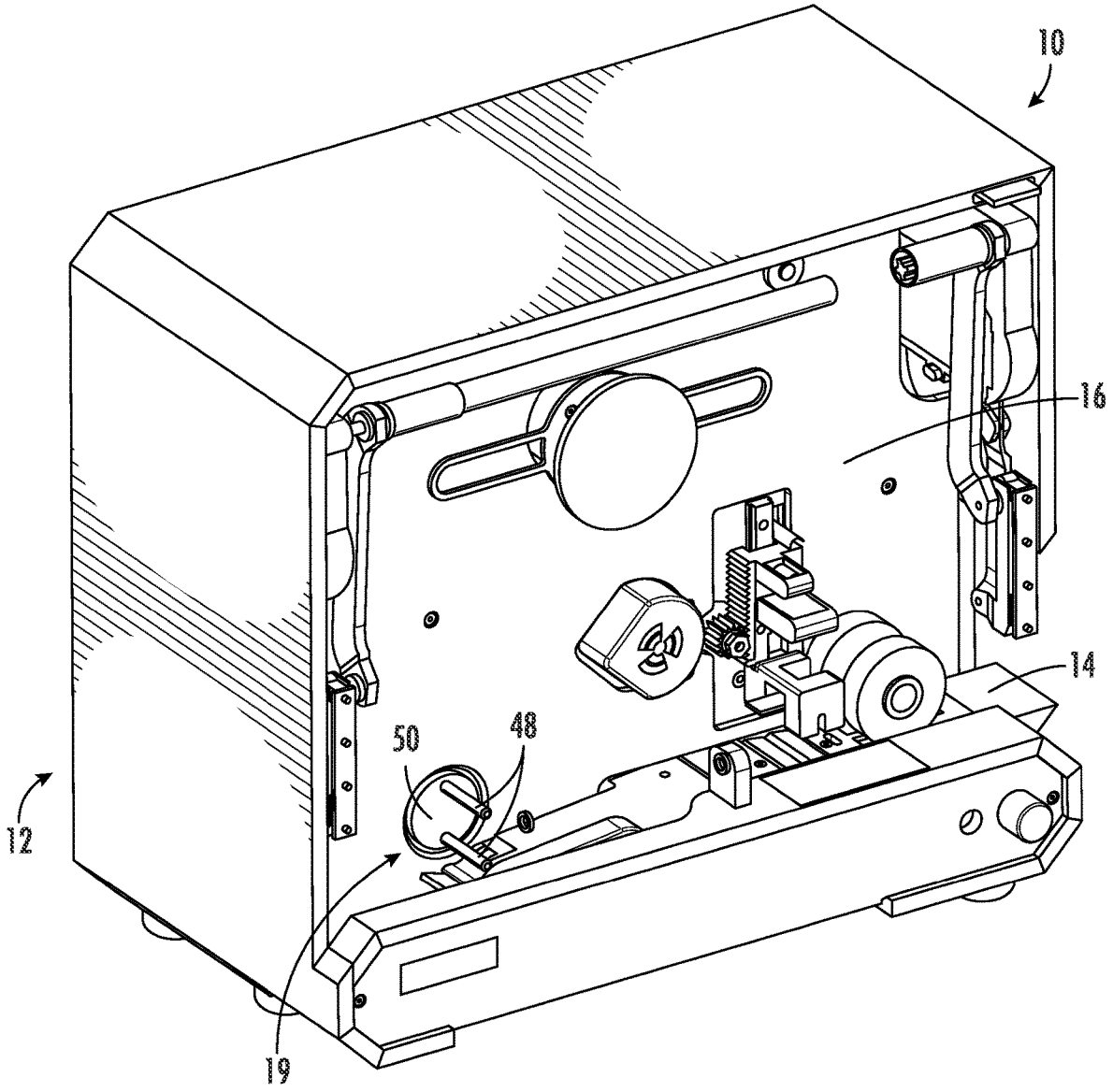
FIG. 3 is a top front perspective view of the cutting and winding machine of FIG. 1 with the cutting and taping stations removed.
Figure 4:
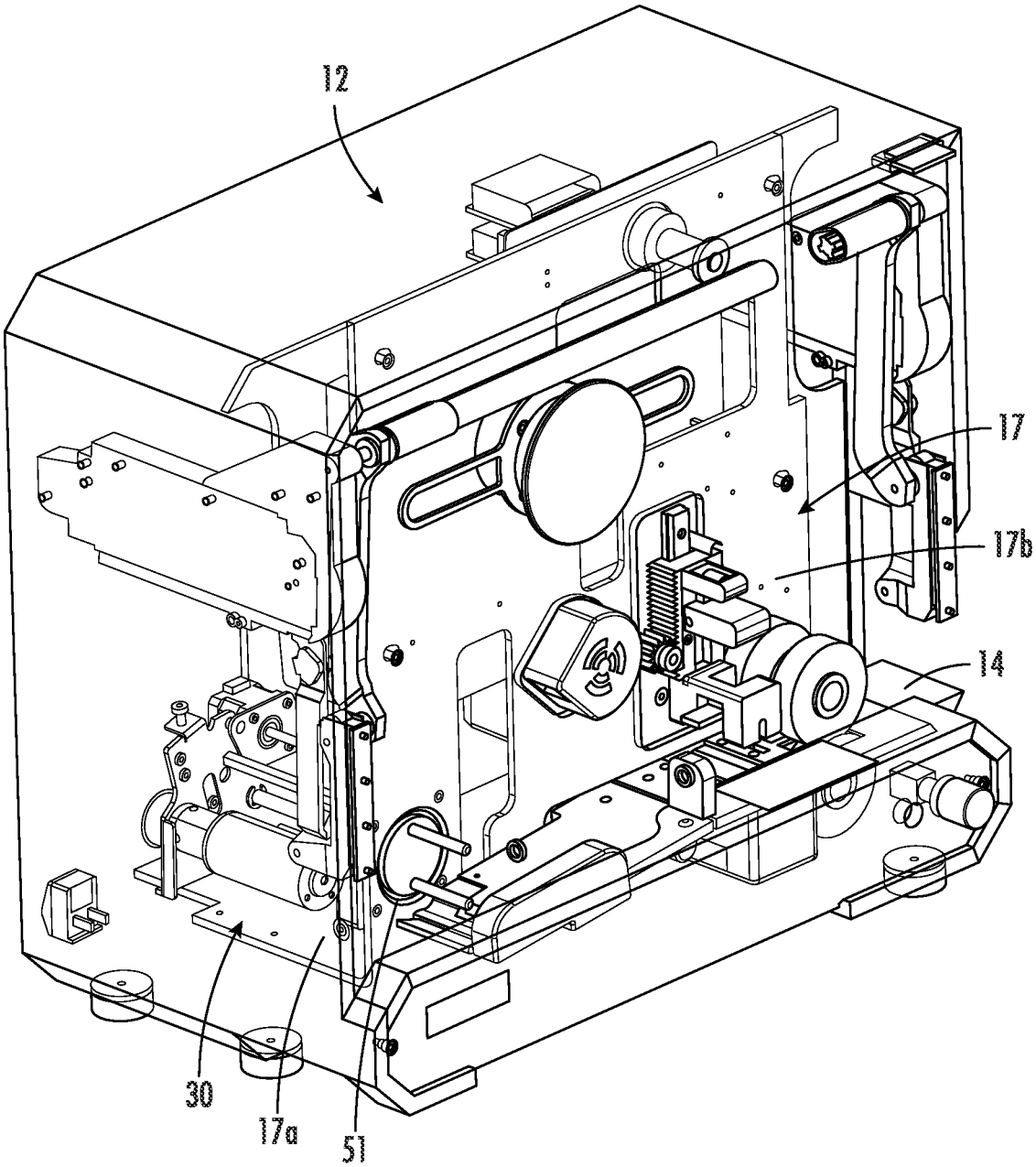
FIG. 4 is a top front perspective view of the cutting and winding machine as in FIG. 3 with the housing shown as transparent.
Figure 5:
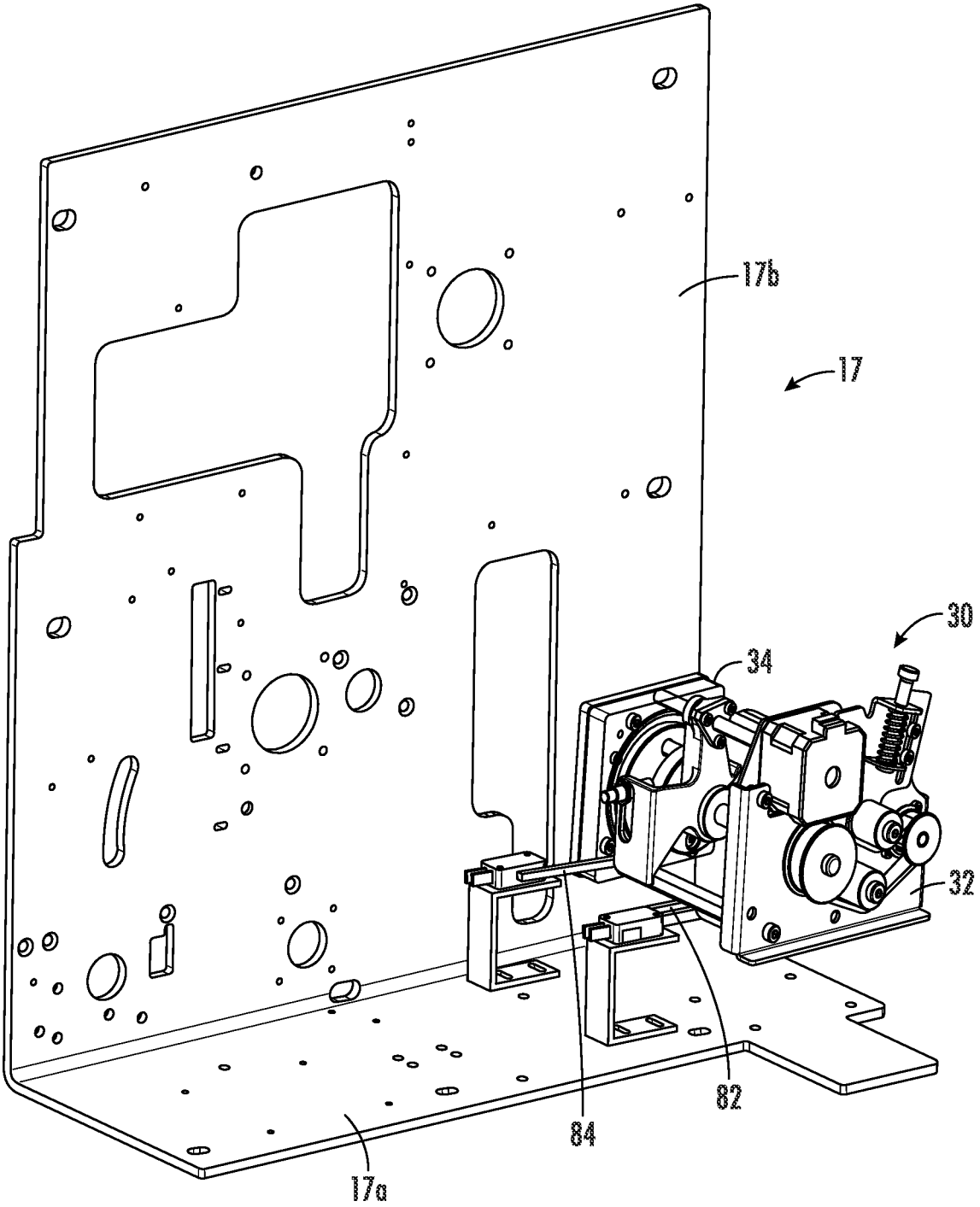
FIG. 5 is a rear perspective view of the foundation of the cutting and winding machine of FIG. 3 with the winding mechanism mounted thereto.
Figure 6:
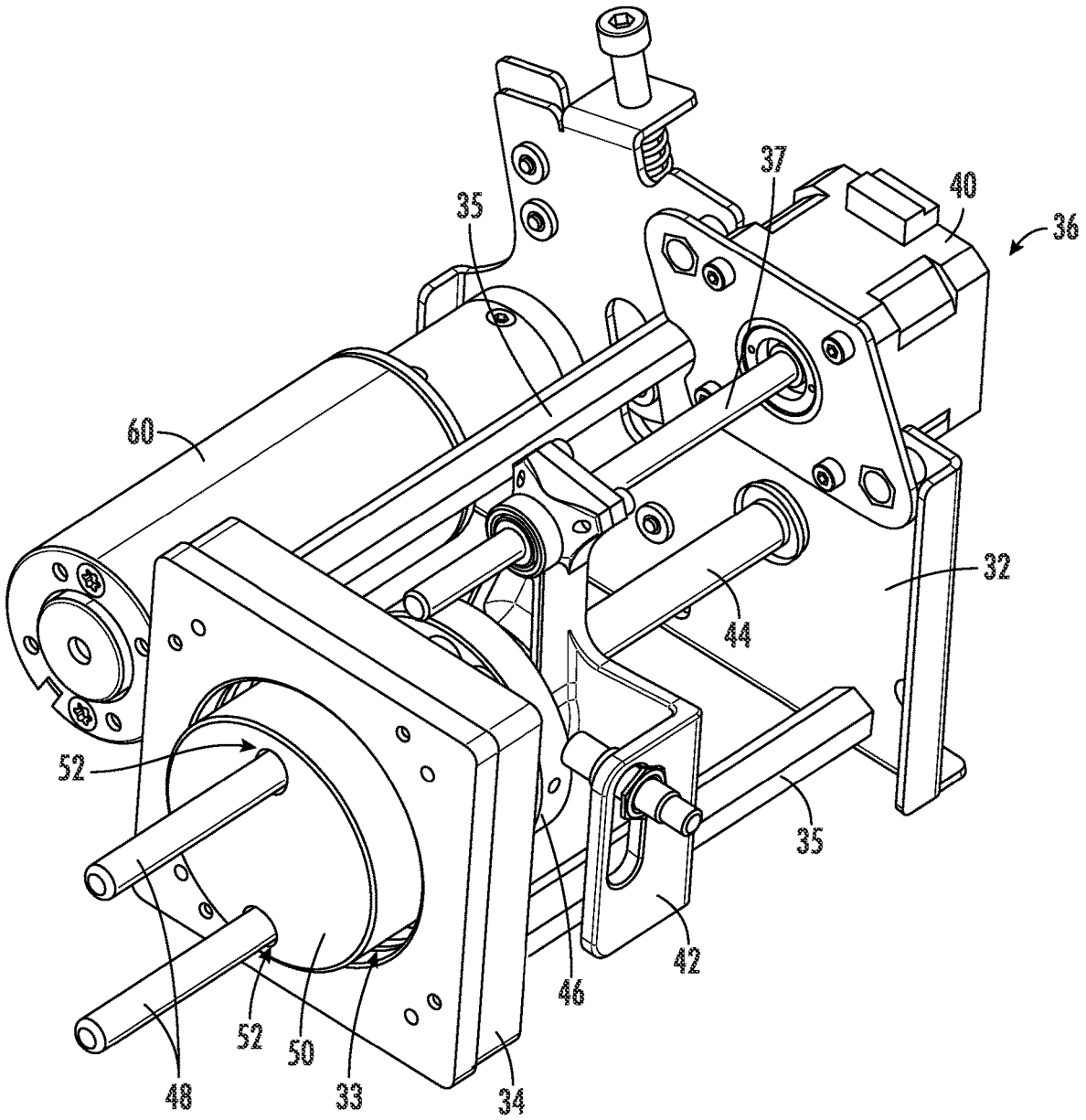
FIG. 6 is a front perspective view of the winding mechanism of FIG. 5 with the carriage and pins shown in their extended position.
Figure 7:
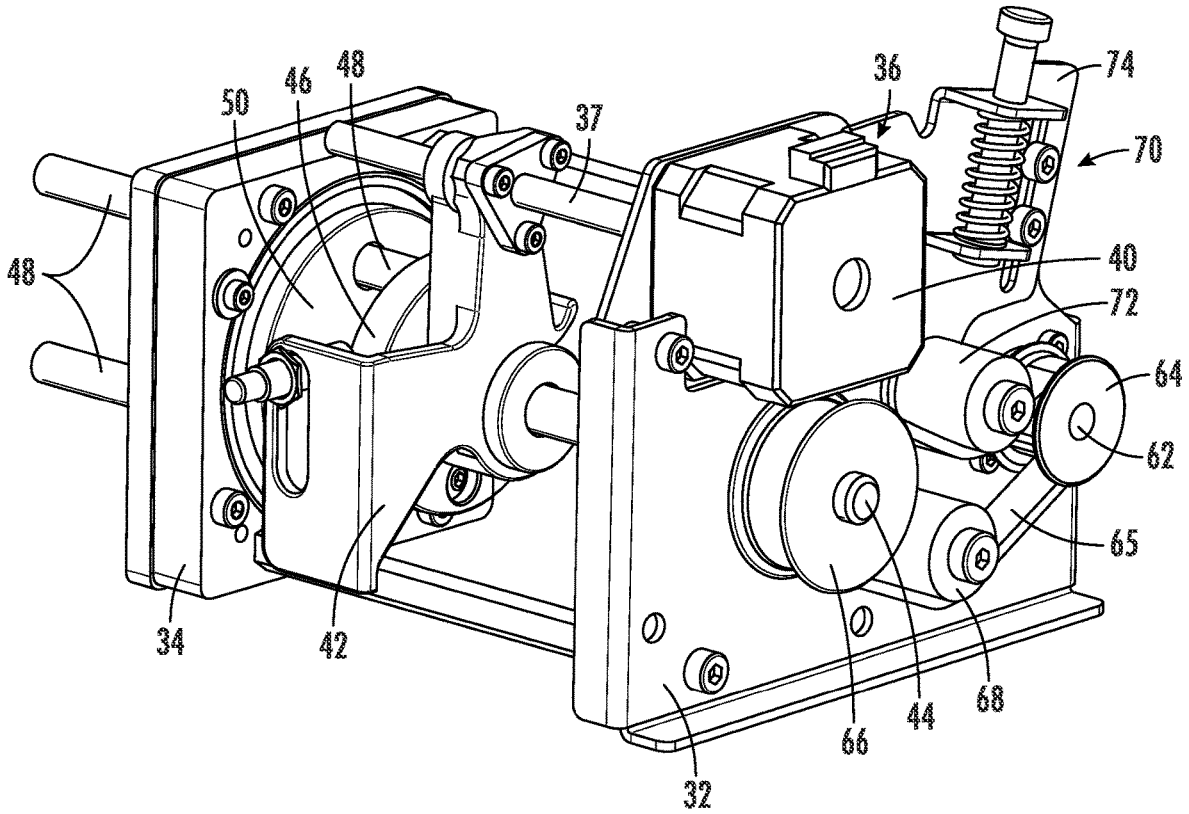
FIG. 7 is a rear perspective view of the winding mechanism of FIG. 5 with the carriage and pins shown in their extended position.
Figure 8:
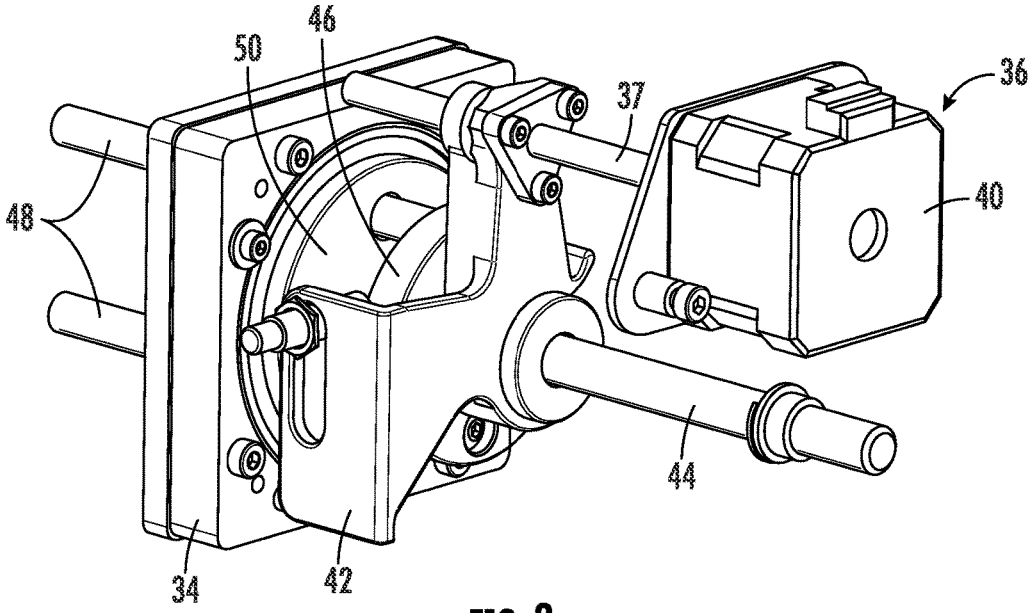
FIG. 8 is a rear perspective view of the winding mechanism as in FIG. 7 with the rotary drive unit and rear wall removed.

Referring to FIGS. 6-8, a largely cylindrical body 50 is rotatably mounted in the vertical wall 34 within a large window 33, and also extends through (a) a hole 51 in the vertical panel 17*b* of the foundation 17 and (b) a hole 19 in the side wall 16 of the housing 12 (see FIGS. 3 and 4). The pins 48 mounted on the hub 46 extend through holes 52 in the cylindrical body 50, and can slide relative to the cylindrical body 50 within the holes 52. The spindle 44 extends into a central hole 54 in the cylindrical body 50; two pins 57 extend radially outwardly from the end of the spindle 44 that is received in the cylindrical body 50 and are received in recesses 56 in the cylindrical body 50 to couple the spindle 44 and the cylindrical body 50 (see FIGS. 9 and 10). As a result, rotation of the spindle 44 also causes the body 50 to rotate.

Referring now to FIGS. 6-8 and 13, a motor 60 is mounted to the vertical wall 32. A shaft 62 extends through a hole in the vertical wall 32 and is connected with a pulley 64. A pulley 66 is mounted to the rear end of the spindle 44. An endless belt 65 engages the pulley 64 and the pulley 66. An idler pulley 68 is mounted to the vertical wall 32 between the pulley 64 and the pulley 66 and engages the belt 65. A belt-tightening unit 70 is mounted to the vertical wall 32 above the idler pulley 68 and includes a pulley 72 that engages the belt 65. The belt-tightening unit 70 further includes a bracket 74 that is mounted to the vertical wall 32 so that the position of the pulley 72 can be adjusted to tighten or loosen the belt 65.

As can be envisioned from FIGS. 6-8 and 13, when the motor 60 is energized, the shaft 62 rotates about an output axis of rotation. Rotation of the shaft 62 rotates the pulley 64, which in turn drives the belt 65 about the path defined by the pulley 64, the idler pulley 68, the pulley 66 and the pulley 72. Rotation of the pulley 66 causes the spindle 44 to rotate about its longitudinal axis. This rotation causes the cylindrical body 50 to rotate, such that the hub 46 and pins 48 rotate also.

Figure 9:
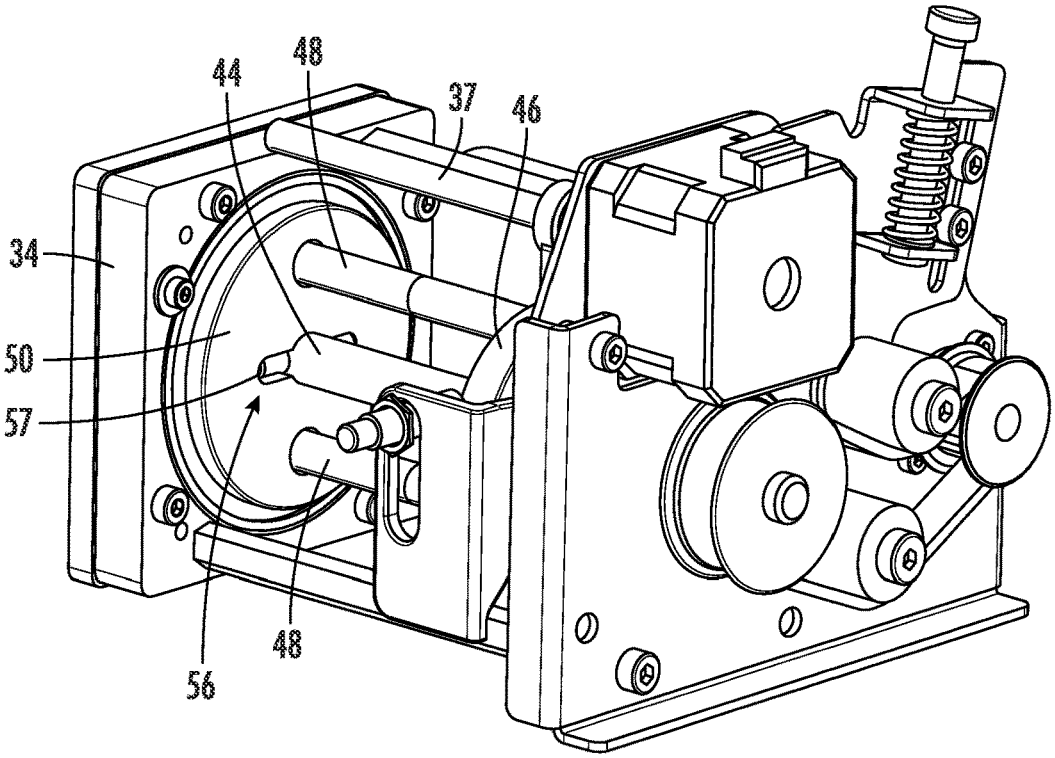
FIG. 9 is a rear perspective view of the winding mechanism of FIG. 5 with the carriage and pins shown in their retracted position.
Figure 10:
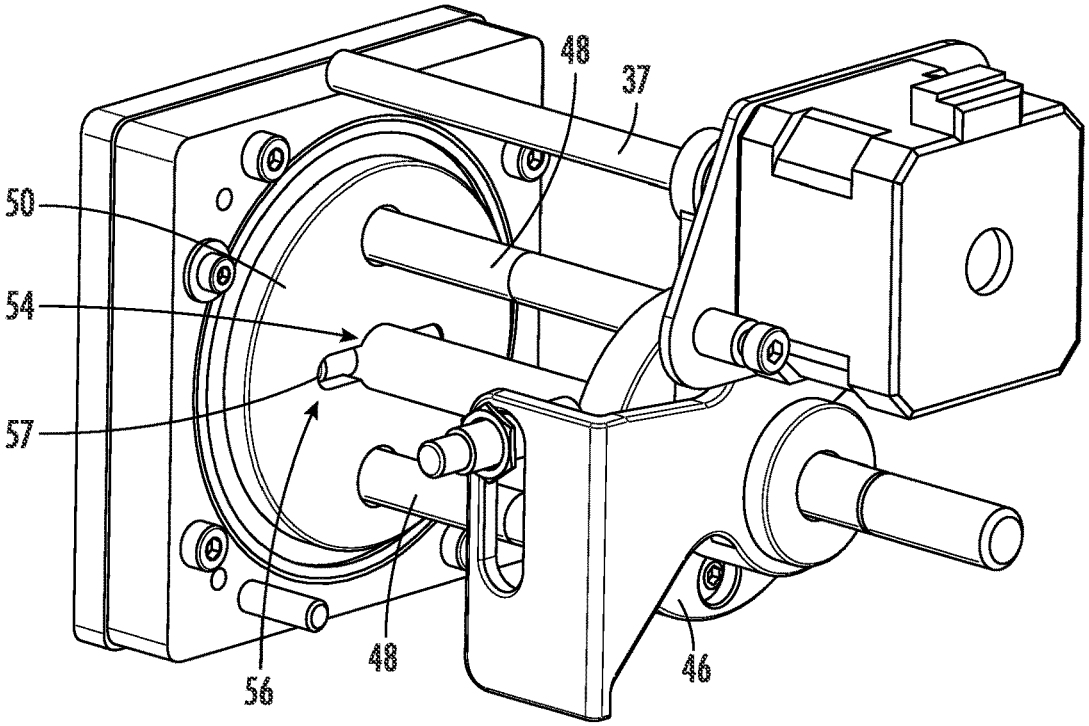
FIG. 10 is a rear perspective view of the winding mechanism as in FIG. 9 with the rotary drive unit and rear wall removed.
Figure 16:
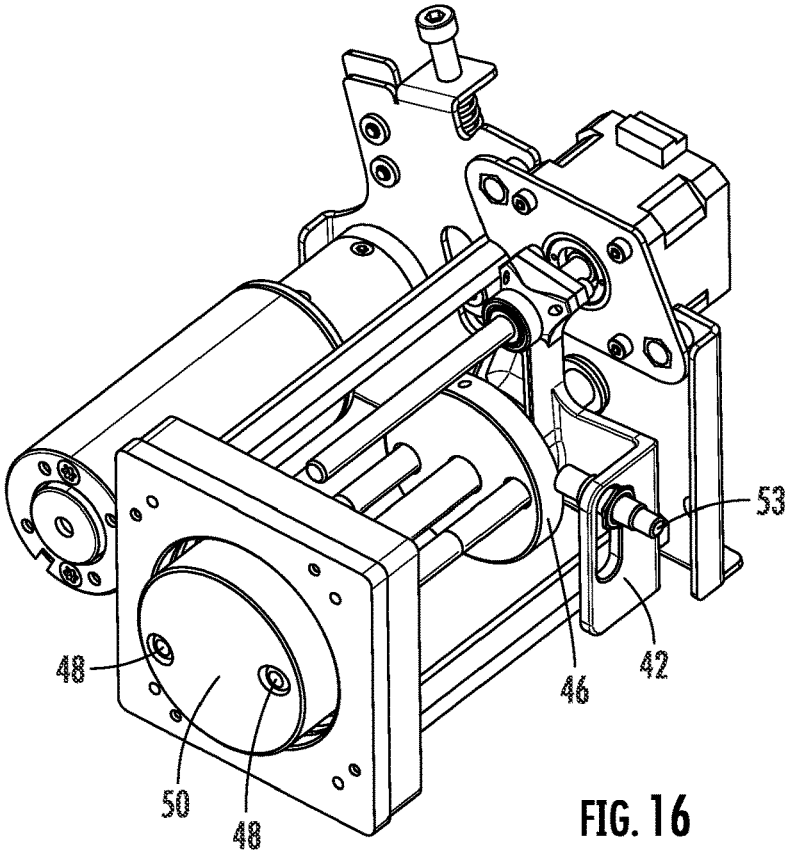
FIG. 16 is a front perspective view of the winding mechanism of FIG. 5 shown in its retracted position with the pins in a horizontal orientation.

In addition, the motor 40 of the linear actuator 36 can cause the carriage 42 to move along the screw 37, and in turn cause the hub 46 and the pins 48 to travel along the axis defined by the spindle 44. As shown in FIGS. 9, 10 and 16, when the carriage 42 is driven by the motor 40 along the screw 37 to a retracted position near the foundation wall 32, the hub 46 is drawn away from the vertical wall 34, and as a result the pins 48 are retracted so that little, if any, of the free ends of the pins 48 extend beyond the surface of the cylindrical body 50. However, as shown in FIGS. 6-8 and 15, when the carriage 42 is driven along the screw 37 toward the vertical wall 34 to an extended position, the free ends of the pins 48 extend through and beyond the surface of the cylindrical guide 50.

Figure 14:
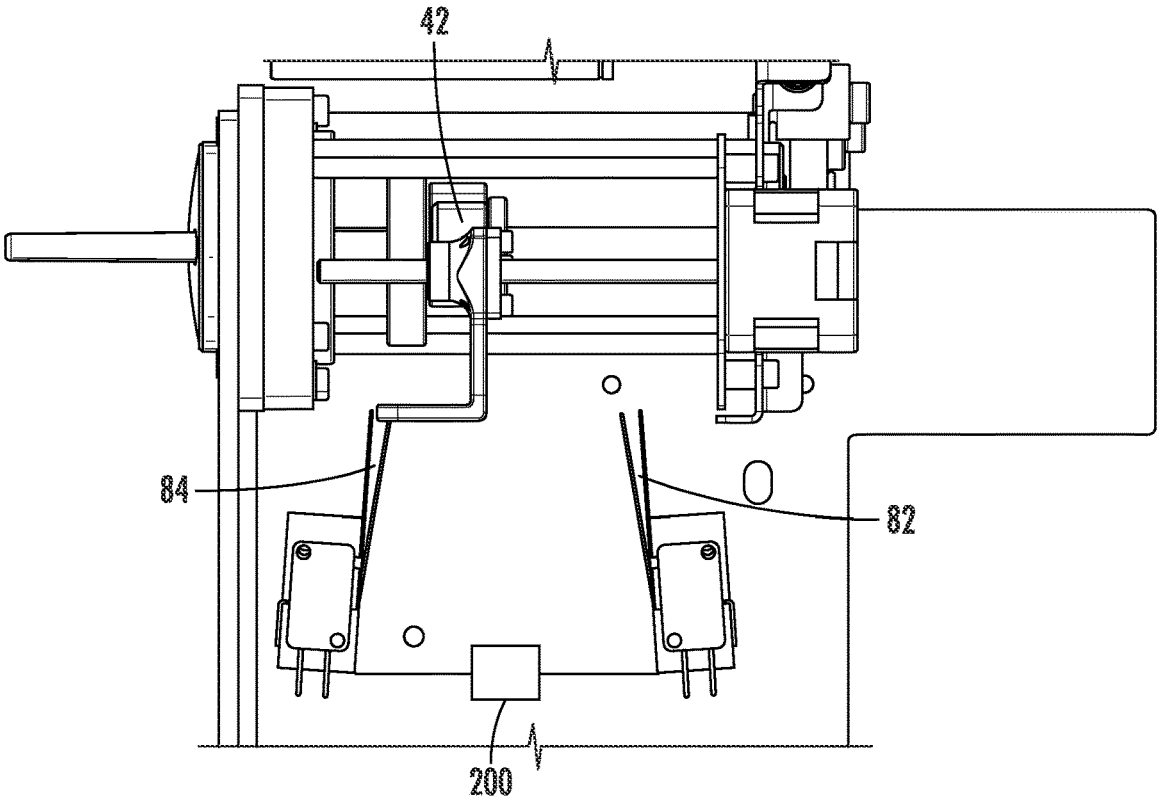
FIG. 14 is a partial top view of the winding mechanism of FIG. 5 showing the limit switches that define the extended and retracted positions.
Figure 15:
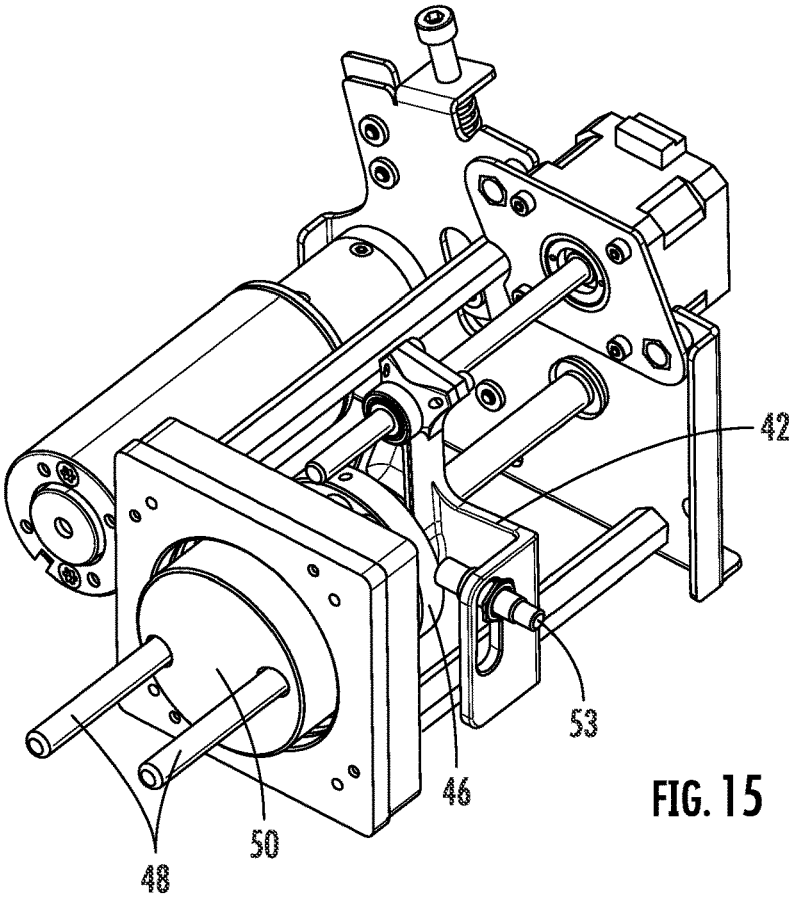
FIG. 15 is a front perspective view of the winding mechanism of FIG. 5 shown in its extended position with the pins in a horizontal orientation.

Limit switches 82, 84 mounted on the horizontal panel 17*a* of the foundation 17 adjacent the carriage 42 (and operatively connected with a controller 200) can provide the travel limits for the carriage 42 along the screw 37 of the linear actuator 36 (see FIG. 14). The controller 200 may also be operatively connected with the motor 60, the linear actuator 36, the roller 18, the cutting station 20, and the taping station 21.

In the operation, the cutting and winding machine 10 receives a strip of pouches from a source of same. Typically the strip of pouches is quite lengthy, and includes all of the pouches of several different segments of pouches that are to be separated and rolled by the cutting and winding machine 10. The source may be simply a reel from which the strip of pouches is unwound, or may comprise another piece of pouch processing equipment. As one example, the source may be an inspection device that inspects the contents and/or markings of each pouch in the strip to confirm that the pouch is correctly filled and/or labeled, then feeds the strip of pouches to the cutting and winding machine 10. FIG. 1 shows a pouch packaging inspection device 100 positioned to feed a long strip of pouches into the machine 10. An exemplary inspection device is the PARATA PERL® inspection system, available from Parata Systems (Durham, North Carolina).

Figure 17:
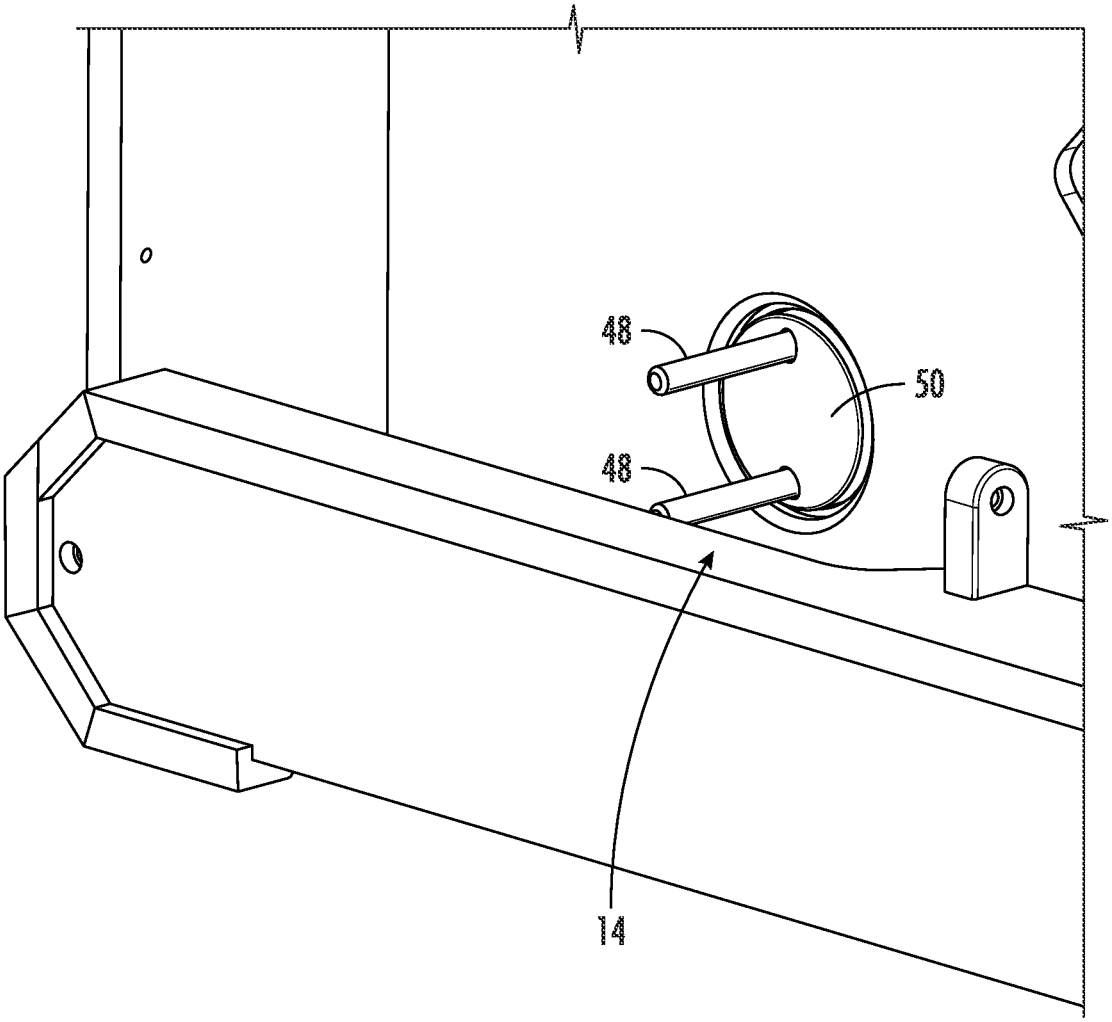
FIG. 17 is a partial front perspective view of the cutting and winding machine of FIG. 1 showing the pins in a vertical orientation in preparation to receive an advancing strip of pouches.

The strip of pouches is loaded into the cutting and winding machine 10 by feeding the leading end of the strip into the nip formed by the roller 18 and the lower second roller. The lower roller is driven by the motor (not shown) mounted on the opposite side of the side wall 16 and foundation 17 and drives the strip toward the winding mechanism 30. As the leading edge of the strip approaches the winding mechanism 30, the linear actuator 36 has driven the carriage 42 and hub 46 forward (i.e., toward the vertical wall 34) to the extended position of FIGS. 6, 8, 15 and 17 so that the pins 48 extend through the cylindrical body 50. In addition, the motor 60 has driven the belt 65 to drive the pulley 72 and spindle 44 so that cylindrical body 50 orients the pins 48 to be generally vertically aligned (see FIGS. 6 and 17), with one pin 48 above the platform 14 and the other pin 48 below the platform 14. This arrangement enables the leading edge of the strip to travel between the pins 48, where it can be captured by the pins 48.

Once the leading edge of the strip has passed the pins 48, the motor 60 is energized, which rotates the spindle 44 and causes the cylindrical body 50 (and in turn the pins 48 and the hub 46) to rotate about the axis defined by the spindle 44. The rotating pins 48 capture the leading edge of the strip and begin to wind the strip into a coil around the pins 48. The strip continues to be fed through the nip by the roller 18 along the platform 14 to the pins 48, where continued rotation of the pins 48 causes the coil to grow with additional layers.

When the portion of the strip that represents the end of a segment reaches the nip, the lower roller ceases to drive the strip forward. This action is typically controlled by the controller 200, which includes information about how the strips are to be separated into segments of strips. The controller 200 may rely on a bar code reader or other scanning device, or may rely on associated equipment (such as the pouch package inspection device 100) to provide this information. When the controller 200 signals that the strip is to be cut, a carriage of the cutting station descends onto the strip and forces it into a blade positioned below the platform 14 to slice the strip, which separates one segment of pouches from the next (the blade is protected by resilient guards that prevent the blade for interfering with the strip prior to the carriage of the cutting station being lowered). Also, at the taping station 21, a strip of adhesive tape (supplied by the tape supply reel 22) is applied to the lagging end of the downstream pouch strip segment. The motor 60 continues to rotate the pins 48 until the entire pouch strip segment has been rolled; this action also causes the tape applied to the lagging end of the pouch strip segment to overlap and adhere to the rolled segment, which prevents the segment from unrolling.

Once rolling and taping of the pouch strip segment is complete, the linear actuator 36 draws the carriage 42 toward the vertical wall 32 to its retracted position (FIG. 16), which retracts the pins 48 into the cylindrical body 50. This action disengages the rolled pouch strip segment from the pins 48, which allows the rolled pouch strip segment to drop through an opening or gap in the platform 14 and into a collection vessel (e.g., a bin) positioned underneath. The linear actuator 36 can then move the carriage 42 (and in turn the pins 48) to the extended position of FIG. 6 to receive the leading edge of the next strip segment.

Those of skill in this art will appreciate that the machine 10 and its components may take different forms. For example, the manner in which the strip is fed to the winding mechanism 30 may differ, as may the manner in which a rolled pouch strip segment is processed to prevent unrolling (e.g., a liquid or paste adhesive may be applied to the lagging end of the strip rather than tape, or a band may be wrapped around the rolled pouch segment). Collection of the rolled pouch strip segments may also differ; for example, a conveyor may be present to convey the rolled pouch strip segment to another location for collection.

The winding mechanism 30 may also take other forms. For example, the belt-tightening unit may be omitted, and/or the path of the endless belt 65 may vary due to the presence of more or fewer pulleys. Engagement of the hub 46 with the carriage 42 may vary (for example, the recess 43 may have an open lower end rather than an open side). Also, a different variety of linear actuator may be employed (for example, a rail may replace the screw 37, and the carriage 42 may be translated along the rail electromagnetically). Components (e.g., ball bearings) may be present to facilitate rotation of the cylindrical hub within the vertical wall 34, foundation 17 and/or side wall 16. The carriage 42 may include a sensor (shown at 53 in FIGS. 15 and 16) that can detect the rotation orientation of the hub 46 (and thus the pins 48) relative to the spindle 44. Other variations may also be suitable.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

What is claimed is:

1. A winding mechanism for a machine for cutting and rolling a strip of pharmaceutical pouches, comprising:

first and second vertical walls, wherein the second vertical wall is spaced apart from and generally parallel with the first vertical wall;

a member fixed to and spanning the first and second vertical walls to form a frame;

a spindle rotatably mounted in the first vertical wall;

a cylindrical body rotatably mounted in the second vertical wall and coupled to the spindle to rotate with the spindle;

a hub slidably and rotatably mounted on the spindle, the hub including first and second pins that extend into and are slidable relative to the cylindrical body;

a rotary drive unit mounted to the first vertical wall and coupled to the spindle to rotate the spindle relative to the first and second vertical walls;

a linear actuator mounted to one of the first and second vertical walls; and a carriage mounted on the linear actuator for linear movement and slidably mounted on the spindle between the hub and the first vertical wall, the carriage engaging the hub and permitting rotation of the hub relative to the carriage;

wherein the carriage is movable along the linear actuator between a retracted position, wherein the first and second pins are retracted into the cylindrical body, and an extended position, in which ends of the first and second pins extend beyond the cylindrical body.

2. The mechanism defined in claim 1, wherein the rotary drive unit includes a motor, and wherein the motor is mounted on a first side of the first vertical wall that faces the second vertical wall.

3. The mechanism defined in claim 2, wherein the motor is coupled to the spindle via an endless belt.

4. The mechanism defined in claim 3, wherein the rotary drive unit further includes a pulley mounted to the first vertical wall that engages the endless belt, the pulley being adjustable relative to the first vertical wall to adjust the tightness of the belt.

5. The mechanism defined in claim 1, wherein the hub includes a projection that extends toward the first vertical wall, and the carriage includes a recess that receives the projection to capture the hub with the carriage.

6. The mechanism defined in claim 1, further comprising first and second limit switches fixedly mounted relative to the linear actuator, the first and second limit switches operatively connected with a controller to sense when the carriage is in the retracted position or the extended position.

7. A machine for cutting and rolling a strip of pharmaceutical pouches, comprising:

a housing with a horizontal platform and a vertical side wall;

a first roller mounted on a front side of the side wall above the platform, a second roller mounted on the front side of the side wall, the second roller forming a nip with the first roller; and a winding mechanism as defined in claim 1 mounted on the side wall, wherein the second vertical wall is fixed relative to the side wall;

wherein in the extended position the first and second pins extend forwardly of the side wall.

8. The machine defined in claim 7, further comprising a cutting station mounted adjacent the second roller.

9. The machine defined in claim 8, further comprising a taping station mounted adjacent the second roller, the taping station including a tape reel mounted to the side wall.

10. The machine defined in claim 7, wherein the pins are configured to be rotated to a position in which the first pin is above the platform and the second pin is below the platform.

11. The machine defined in claim 7, wherein the machine is configured to be coupled with a pouch inspection machine, wherein the pouch inspection machine is configured to feed a strip of pouches into the nip.

12. The machine defined in claim 7, wherein the rotary drive unit includes a motor, and wherein the motor is mounted on a first side of the first vertical wall that faces the second vertical wall.

13. The machine defined in claim 12, wherein the motor is coupled to the spindle via an endless belt.

14. The machine defined in claim 13, wherein the rotary drive unit further includes a pulley mounted to the first vertical wall that engages the endless belt, the pulley being adjustable relative to the first vertical wall to adjust the tightness of the belt.

15. The machine defined in claim 7, wherein the hub includes a projection that extends toward the first vertical wall, and the carriage includes a recess that receives the projection to capture the hub with the carriage.

16. The machine defined in claim 7, further comprising first and second limit switches fixedly mounted relative to the linear actuator, the first and second limit switches operatively connected with a controller to sense when the carriage is in the retracted position or the extended position.

* * * * *